US006241641B1

(12) United States Patent
Sawyer

(10) Patent No.: US 6,241,641 B1
(45) Date of Patent: Jun. 5, 2001

(54) METHOD FOR ESTABLISHING EXERCISE ACTIVITIES USING RECYCLABLE MATERIALS AND RELATED STRUCTURES

(76) Inventor: Jonathan Sawyer, 10 Congress Square Plz., Portland, ME (US) 04101

( * ) Notice: Subject to any disclaimer, the term of this patent is extended or adjusted under 35 U.S.C. 154(b) by 0 days.

(21) Appl. No.: 09/388,680

(22) Filed: Sep. 2, 1999

(51) Int. Cl.[7] ..... A63B 21/072
(52) U.S. Cl. ..... 482/108; 482/105
(58) Field of Search ..... 482/50, 93, 105–109

(56) References Cited

U.S. PATENT DOCUMENTS

| | | |
|---|---|---|
| 3,756,597 | 9/1973 | Monti . |
| 4,029,312 | 6/1977 | Wright . |
| 4,651,988 | 3/1987 | Sobel . |
| 4,712,794 | 12/1987 | Hall . |
| 4,854,575 | 8/1989 | Wilson et al. . |
| 4,997,184 | 3/1991 | Sherman . |
| 5,379,909 | 1/1995 | Roark . |
| 5,431,615 | 7/1995 | Correll . |
| 5,445,587 | 8/1995 | Brown . |
| 5,580,343 | 12/1996 | Cafiero . |
| 5,857,946 | 1/1999 | Brown . |

*Primary Examiner*—Michael A. Brown
*Assistant Examiner*—Lalita M. Hamilton
(74) *Attorney, Agent, or Firm*—Pierce Atwood; Chris A. Caseiro

(57) ABSTRACT

An exercise device and business method for employing an existing plastic container as the exercise device. The exercise device is an existing plastic container originally used as a container for a conventional consumer product. Upon depletion of the original contents, the container is to be used as an exercise device by filling it with a suitable benign filler to a level of interest in order to establish a desired weight of the container. The container must be one that includes a handle designed for balanced holding thereof. The associated business method involves the application to the container of instructions for the new use of the container as an exercise device and the associated environmental and health benefits related to recycling of the container as the exercise device. Optional demarcation lines may be applied to the container to define specific weight levels as a function of the filler employed.

7 Claims, 1 Drawing Sheet

METHOD FOR ESTABLISHING EXERCISE ACTIVITIES USING RECYCLABLE MATERIALS AND RELATED STRUCTURES

BACKGROUND OF THE INVENTION

1. Field of Invention

The present invention relates to new uses for known consumer products. More particularly, the present invention relates to the simple conversion of recyclable plastic containers into exercise devices. Still more particularly, the present invention relates to a method for instructing consumers how to convert existing handheld containers into exercise equipment and the appropriate usage therefor, along with related methods for marketing by container suppliers of such alternative container usage.

2. Description of the Prior Art

It is well known that many consumer products are supplied in containers having a wide array of configurations. They may be formed from a variety of materials, including plastic, metal, or coated paper; however, many are made of plastic. Once the contents of the container have been depleted, the consumer generally throws the container away, although there is a certain fraction of the total number of used containers that are recycled. In any case, there is generally the single usage and then a discarding of the container. It would be beneficial to find one or more alternative uses for such containers.

For any consumer who must transport a filled container from one location to another it is clear that there is work involved in such a task. To that end, there is, to a limited extent, exercise involved in that activity, whether it is to move a liquid-detergent container from a vehicle to a laundry room, or to lift the container from its stowage location for use. Since it is well known that exercise enhances the quality of life and wellness, it is a desirable goal to enable people to exercise. Unfortunately, with busy lives and the apparent increasing desire to make life easier, individuals often forego regular directed exercise that would otherwise improve their physical condition. While there are many exercise facilities, many individuals find it time consuming to travel to such locations. In addition, many individuals feel uncomfortable exercising with others, or in view of others, who may or may not be in better condition. The alternative is to exercise at home; however, for weightlifting activities, for example, the equipment that is generally available can be relatively costly. In addition, commercially available weightlifting equipment generally comes in fixed increments of weight that may not be particularly suitable for individuals requiring incremental modifications different from those available through existing products.

In the prior art there have been developed relatively compact exercise devices designed to assist users in conducting exercises in a location of interest-such as the home. For example, U.S. Pat. No. 5,580,343 issued to Cafiero describes the formation of a handle designed to be attached to a refillable plastic container. The handle can be affixed to the exterior of a bottle to provide stability and strength that may not be present in the bottle alone during such a use. Cafiero describes the application of the handle to a standard container such as a water or soda bottle. In that way, the user can regulate the weight to be lifted. Cafiero specifically notes that existing water bottles are difficult to hold alone and therefore require his attachable handle. U.S. Pat. No. 4,651,988 issued to Sobel, also describes a dumbbell formed by a beverage can and attachable handle. Both products require the fabrication of a new component—namely that of the attachable handle.

U.S. Pat. No. 5,379,909 issued to Roark describes the application of a dual-sided closure that can be threaded to the "top" of one or two fillable containers. The closure is designed to enable the user to hold the container for exercising. It also enables the user to fill the container to achieve a desired container weight. U.S. Pat. No. 5,857,946 issued to Brown describes the fabrication of a refillable container of specific design for ease of handling and transport. Brown teaches that parallel lines and weight scales for various solids or liquids can be marked on the customized container to allow for filling the container with different materials to specific weights. Such a container would simply add to the mass of plastic containers requiring disposal at some point in the future. These two disclosures also require the manufacture of a new custom product—either the closure device or the custom container.

Each of the prior in-home exercise systems described in the noted disclosures require the fabrication of some new device, whether a handle, a closure device, or a new container. In that regard they are designed to add to the overall waste stream and the cost to the consumer. Moreover, there is little, if any, in the way of instruction provided to the consumer in describing the appropriate way to exercise, or the appropriate weight required for effect for a particular individual.

Therefore, what is needed is an exercise device that may be used in any location of interest. What is also needed is such an exercise device created using existing consumer products, such as plastic containers, without requiring additional attachments to convert it into an exercise device. Further, what is needed is a method for advising consumers of the alternative use of an existing consumer-product-based container as an exercise device and suitable techniques for effecting proper exercise activities.

SUMMARY OF THE INVENTION

It is an object of the present invention to provide an exercise device that may be used in any location of interest. It is also an object of the present invention to provide an exercise device created using existing consumer products, such as plastic containers, without requiring additional attachments to convert it into an exercise device. Further, it is an object of the present invention to provide a method for advising consumers of the alternative use of an existing consumer-product-based container as an exercise device and suitable techniques for effecting proper exercise activities.

These and other objectives are achieved in the present invention through the new use of a known product and a method for advising consumers of such new usage and details related thereto. Specifically, the present invention involves the disclosure of the use of a conventional consumer product that is a relatively hefty plastic container, such as a liquid detergent container capable of holding a volume of one-half gallon or more, as a weight-carrying exercise tool. It is important to note that the container must be of the type having an existing well-balanced handle that is substantially centered in the area of the center of mass of the container. Whereas consumers ordinarily throw out such containers when empty, the consumer is directed to fill the existing container through its pour spout with some sort of dense, readily available, material, such as water, sand, etc. This is of particular convenience for people of all ages in that it eliminates the need to buy relatively expensive dumbbells, or to pay the price of membership at the local health club.

The present invention also involves the development of a marketing system to advise consumers of the alternative environmentally friendly and healthwise usage of the container that previously has had but one usage option prior to discarding. Specifically, the supplier of the standard consumable retained in the existing balanced container may continue to provide its existing product and, in addition, gain consumer support and interest in such products by noting the supplemental use of such a container after the original contents have been consumed. Such instructions to the consumer may involve a simple notation of the environmental benefit of such usage, and/or detailed instructions regarding exercise options. This may further include the introduction of demarcation lines that may be inscribed or otherwise applied to the container such that the user can create a training device of a specific weight, depending upon the filler material used and the particular added fill line used to identify how much material to introduce for the selectable weight. Through this method, the supplier can increase consumer awareness of proper exercise techniques, increase the chance that the container will be kept out of the waste stream, provide a more favorable interface with the consumer and therefore increased likelihood of repeat sales. It may also assist the supplier in targeting particular consumers for specific products.

It is to be understood that other objects and advantages of the present invention will be made apparent by the following description of the drawings according to the present invention. While a preferred embodiment is disclosed, this is not intended to be limiting. Rather, the principles set forth herein are illustrative of the scope of the present invention and it is to be understood that changes may be made without straying from the scope of the invention.

BRIEF DESCRIPTION OF THE DRAWING

The FIGURE is a side view of the exercise device of the present invention, showing an informational and instruction form and optional weight demarcation lines.

DETAILED DESCRIPTION OF THE PREFERRED EMBODIMENT

Figure 1:
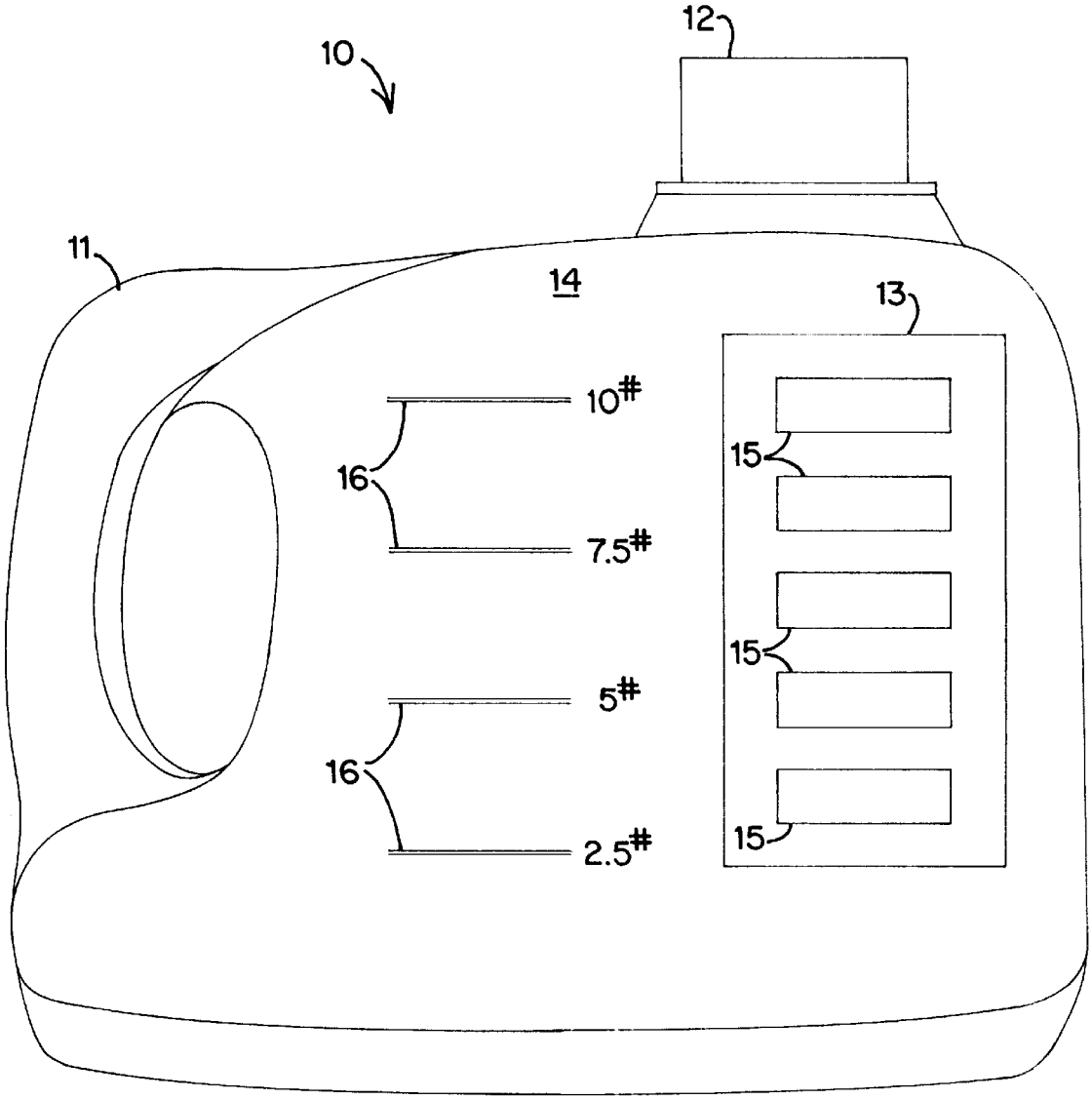

An exercise device 10 of the present invention is shown in the FIGURE. The device 10 is preferably a conventional plastic container of the type used to retain conventional consumer products, such as liquid detergents, for example. Although shown as having a generally rectangular shape, it is contemplated that any sort of conventional plastic container may be employed to create the exercise device 10 after the original product retained therein has been consumed. However, it is important to note that the container must have a handle 11 designed to balance the container and its contents when the container is in use. The container must also have a removable cap 12 to allow a user to insert or remove a filler of suitable density within the container.

A key aspect of the present invention is the new use of an existing product—the container—as the exercise device 10. In order to enable the user to convert the container to this new use, the present invention includes the introduction of an instructional panel 13 onto a surface 14 of the container. The instructional panel 13 includes one or more sets of instructions 15 having: 1) information regarding the environmental benefits associated with re-use of the container as the exercise device; 2) specific directions on one or more exercise activities to perform; and/or 3) directions for the types of benign materials to use to fill the container to set the container at a desired weight that may be adjusted as desired. The container surface 14 may optionally be marked with weight designation lines 16 for defining the level of the filler to be inserted into the container to establish the container's weight for the purpose of specific exercise activities. The designation lines 16 may be marked with specific weight values as a function of the particular filler employed.

A business method related to the use of the exercise device 10 includes several steps associated with informing consumers of the new use of the existing plastic containers. First, the instructional panel 13 must be prepared to provide information at the point-of-sale regarding the environmental and health impact of employing used plastic containers for exercise activities. The instructional panel must further be prepared to provide detailed information regarding selectable exercise activities associated with filling the container to a desired weight and then causing movement of the filled container in a repetitive way to develop and condition an individual's various muscle groups. Beyond the steps associated with point-of-sale informational materials, the business method related to the new use may be disclosed in wide-scale advertising identifying the environmental and health importance of using the exercise device 10. Related internal business steps may include the development of a database of information identifying specific consumers particularly interested in either the environmental or health consequences associated with the new use of the existing containers, and the development of stronger ties to existing and new customers.

It should be understood that the embodiment mentioned here is merely illustrative. Variations therein may be contemplated in view of the following claims without straying from the intended scope of the invention herein disclosed.

What is claimed is:

1. An exercise device comprising a recycled plastic container substantially unmodified from its original state of fabrication and having an existing handle of balanced configuration when said container has contents therein, wherein said container is one previously employed as a retainer of a conventional consumable product, wherein said container includes a removable cap designed to allow a user to fill said container with a filler to a selectable level therein to provide said container with sufficient weight so that it may be deployed as an exercise device, and wherein said container includes a panel attached to the container, said panel having instructions thereon for deploying said container with said filler therein in exercise activities.

2. The exercise device as claimed in claim 1 wherein said filler is water.

3. The exercise device as claimed in claim 1 further comprising a plurality of demarcation lines on a surface of said container, wherein said plurality of demarcation lines define a plurality of levels of said filler to place within said container corresponding to a specific overall weight level of said container with said filler therein at any one of said plurality of levels.

4. A method for improving the business prospects of a supplier of consumer products provided in plastic containers comprising the steps of:

a. applying to the plastic containers one or more informational panels advising consumers of the option of converting the plastic containers into exercise devices and the environmental effects related thereto; and b. providing as part of said one or more informational panels instructions for converting the plastic containers into said exercise devices including information on one or more specific exercise activities.

5. The method as claimed in claim 4 further comprising the step of applying a plurality of marking lines on exterior surfaces of the plastic containers designing a quantity of a filler to insert into the plastic containers once the existing material therein has been depleted in order to establish a specified weight of the plastic containers as a function of the level of said filler therein.

6. The method as claimed in claim 4 wherein the step of providing instructions for converting the plastic containers includes the steps of advising consumers to insert a filler into the container when original contents of the plastic containers have been removed so as to fix a specified selectable weight of the plastic containers for exercise purposes.

7. The method as claimed in claim 6 wherein said filler is selected from the group consisting of water and sand.

* * * * *